US009281624B2

(12) United States Patent
Jeon et al.

(10) Patent No.: US 9,281,624 B2
(45) Date of Patent: Mar. 8, 2016

(54) ELECTRICAL CONNECTOR WITH SIGNAL PATHWAYS AND A SYSTEM HAVING THE SAME

(71) Applicant: Tyco Electronics Corporation, Berwyn, PA (US)

(72) Inventors: Myoungsoo Jeon, Harrisburg, PA (US); Mary Elizabeth Sullivan Malervy, Downingtown, PA (US); Josh Harris Golden, Santa Cruz, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 153 days.

(21) Appl. No.: 13/968,968

(22) Filed: Aug. 16, 2013

(65) Prior Publication Data

US 2015/0050843 A1 Feb. 19, 2015

(51) Int. Cl.

| | |
|---|---|
| ***H01R 33/00*** | (2006.01) |
| ***H01R 13/6477*** | (2011.01) |
| ***H01R 13/6587*** | (2011.01) |
| *H01R 12/73* | (2011.01) |

(52) U.S. Cl.

CPC ..... *H01R 13/6477* (2013.01); *H01R 13/6587* (2013.01); *H01R 12/737* (2013.01)

(58) Field of Classification Search

CPC . H01R 23/725; H01R 23/688; H01R 23/7073
USPC ..... 439/682, 607.09, 607.1
See application file for complete search history.

(56) References Cited

U.S. PATENT DOCUMENTS

| | | | | |
|---|---|---|---|---|
| 6,676,450 | B2 * | 1/2004 | Schroll | 439/607.1 |
| 7,898,356 | B2 | 3/2011 | Sherrer et al. | |
| 8,039,746 | B2 * | 10/2011 | Ashida et al. | 174/88 R |
| 8,287,322 | B2 * | 10/2012 | Jeon | 439/862 |
| 8,430,691 | B2 * | 4/2013 | Davis | 439/607.09 |
| 8,465,323 | B2 * | 6/2013 | Jeon | 439/607.07 |
| 8,715,005 | B2 * | 5/2014 | Pan | 439/607.1 |
| 8,905,786 | B2 * | 12/2014 | Davis et al. | 439/607.1 |
| 8,961,229 | B2 * | 2/2015 | Pan | 439/607.07 |
| 2002/0022401 | A1 * | 2/2002 | Ramey et al. | 439/608 |
| 2012/0083140 | A1 * | 4/2012 | Jeon | 439/65 |
| 2012/0202380 | A1 * | 8/2012 | Lappoehn | 439/607.09 |
| 2013/0017722 | A1 * | 1/2013 | Davis | 439/607.09 |
| 2013/0089993 | A1 * | 4/2013 | Jeon | 439/92 |
| 2015/0011125 | A1 * | 1/2015 | Jeon | 439/620.15 |

* cited by examiner

*Primary Examiner* — Hae Moon Hyeon

(57) ABSTRACT

Electrical connector including a connector body having a mating side configured to interface with an electrical component. The electrical connector also includes signal pathways extending through the connector body. The signal pathways are arranged to form pairs of signal pathways. The electrical connector also includes an impedance-control assembly having a plurality of dielectric bodies supported by the connector body. The dielectric bodies surround respective pairs of signal pathways. The dielectric bodies include a dielectric medium and gas bubbles distributed in the dielectric medium. The dielectric medium has a predetermined dielectric constant. The at least one of the gas bubbles or gas-filled particles are sized and distributed in the dielectric medium to achieve a target dielectric constant of the dielectric bodies.

19 Claims, 4 Drawing Sheets

ELECTRICAL CONNECTOR WITH SIGNAL PATHWAYS AND A SYSTEM HAVING THE SAME

BACKGROUND OF THE INVENTION

The subject matter herein relates generally to an electrical connector and a system having pairs of signal pathways for transmitting differential signals.

Systems, such as those used in networking and telecommunication, use electrical connectors to interconnect components of the systems. The interconnected components may be, for example, a motherboard and a daughter card. However, as speed and performance demands increase, conventional electrical connectors are proving to be insufficient. For example, signal loss and/or signal degradation is a problem in some systems. There is also a desire to increase the density of signal pathways to increase throughput of the systems, without an appreciable increase in size of the electrical connectors. Increasing the density of signal pathways, however, can reduce the performance of the electrical connectors or cause other problems.

In addition to increasing the density of signal pathways, manufacturers have been more willing to adopt different electrical characteristics of the devices. In the past, the industry standard for impedance in certain electrical devices was 100 ohm. The electrical connectors that engaged these devices were configured to match the impedance of the devices (e.g., 100 ohm). More recently, however, manufacturers have adopted device designs having different impedances (e.g., 85 ohms). In many cases, changing the impedance of an electrical device necessitates a structural change in the electrical connector(s) that engage the electrical device. Design changes such as these may be costly. In additions, new tools may be required to manufacture the newly designed connectors.

Accordingly, a need exists for an electrical connector that can be manufactured to have a first impedance (e.g., 85 ohm) or manufactured to have a second impedance (e.g., 100 ohm) without changing the structure of the electrical connector.

BRIEF DESCRIPTION OF THE INVENTION

In one embodiment, an electrical connector is provided that includes a connector body having a mating side configured to interface with an electrical component. The electrical connector also includes signal pathways extending through the connector body. The signal pathways are arranged to form pairs of signal pathways. The electrical connector also includes an impedance-control assembly having a plurality of dielectric bodies supported by the connector body. The dielectric bodies surround respective pairs of signal pathways. The dielectric bodies include a dielectric medium and at least one of gas bubbles or gas-filled particles distributed in the dielectric medium. The dielectric medium has a predetermined dielectric constant. The gas bubbles or gas-filled particles are sized and distributed in the dielectric medium to achieve a target dielectric constant of the dielectric bodies.

Optionally, the dielectric ribs may include polymeric foam having the dielectric medium and the gas bubbles or gas-filled particles. The target dielectric constant of the dielectric bodies may be, for example, between 1.5 and 4.0. One or more methods of adding the at least one of gas bubbles or gas-filled particles to the dielectric medium may be used. For example, the dielectric bodies may have microspheres that include the gas bubbles (i.e., gas-filled particles). The dielectric bodies may also be blow-agent molded or supercritical-gas molded to produce pores throughout the material. In particular embodiments, the dielectric bodies have a gas-to-material ratio between 1:10 and 3:1. A cross-sectional impedance of the pairs of conductors surrounded by the dielectric bodies may be, for example, either about 100 ohm or about 85 ohm.

In another embodiment, an electrical connector is provided. The electrical connector includes a series of contact modules stacked side-by-side forming a connector body. The connector body has a mounting side and a mating side. Each of the contact modules includes a plurality of dielectric ribs that extend generally between the mating and mounting sides. The electrical connector also includes signal pathways extending through each of the contact modules. Each of the dielectric ribs surrounds at least a portion of one of the signal pathways. The dielectric ribs include a dielectric medium and at least one of gas bubbles or gas-filled particles distributed in the dielectric medium. The dielectric medium has a predetermined dielectric constant, wherein the gas bubbles or the gas-filed particles are sized and distributed in the dielectric medium to achieve a target dielectric constant of the dielectric ribs.

In another embodiment, a system (e.g., a communication system) is provided that includes receptacle and header connectors configured to engage each other at a mating interface. Each of the receptacle and header connectors is configured to be coupled to a respective electrical component. At least one of the receptacle and header connectors includes a connector body having a mating side and signal pathways that extend through the connector body. The signal pathways are arranged to form pairs of signal pathways. Said at least one of the receptacle and header connectors also includes an impedance-control assembly having a plurality of dielectric bodies that are supported by the connector body. The dielectric bodies surround respective pairs of signal pathways, wherein the dielectric bodies include a dielectric medium and at least one of gas bubbles or gas-filled particles distributed in the dielectric medium. The dielectric medium has a predetermined dielectric constant, and the gas bubbles and/or the gas-filled particles are sized and distributed in the dielectric medium to achieve a target dielectric constant of the dielectric bodies.

In particular embodiments, the system is a backplane system in which each of the header and receptacle connectors is configured to be mounted to a circuit (e.g., mother board or daughter card). The backplane system may be capable of transmitting data signals at greater than 20 Gbps.

DETAILED DESCRIPTION OF THE INVENTION

Embodiments described herein include systems (e.g., communication systems) and electrical connectors that are configured to transmit data signals. In particular embodiments, the systems and the electrical connectors are configured for high-speed signal transmission, such as 10 Gbps, 20 Gbps, or more. Embodiments include signal pathways that are surrounded by one or more dielectric bodies. A dielectric body may be, for example, an overmold that separates the signal pathways from adjacent signal pathways or other conductive material. As used herein, the term "signal pathway" includes one or more conductive elements through which data signals are capable of being transmitted. For instance, a single signal pathway may include a signal conductor of a first electrical connector, wherein the signal conductor includes opposite conductor tails (or ends) and a signal conductor that extends between the opposite conductor tails. The single signal pathway may also include an electrical contact (or terminal contact) of a second electrical connector that mates with the first electrical connector. For example, the electrical contact may directly engage one of the conductor tails.

At least a portion of a signal pathway may be surrounded by a dielectric body. As used herein, the term "surrounded" includes the dielectric body being molded around the signal pathway such that the dielectric medium of the dielectric body is intimately engaged with a conductive element (e.g., encasing the conductive element) of the signal pathway. The term "surrounded" also includes the dielectric medium of the dielectric body surrounding but being spaced apart from the conductive element such that an air gap exists between the dielectric body and the conductive element. In either case, the dielectric body and the signal pathway are configured relative to each other to achieve a target impedance. In various embodiments, the dielectric body includes a dielectric medium and at least one of gas bubbles or gas-filled particles that are distributed in the dielectric medium. The gas bubbles and/or the gas-filled particles may also be referred to as gas cells. To achieve a target dielectric constant of the dielectric bodies and thereby achieve a target impedance of the electrical connector, the dielectric medium may be configured to have a predetermined dielectric constant and the gas bubbles and/or the gas-filled particles may be configured to have a predetermined size and distribution within the dielectric medium. The gas (e.g., air) within the dielectric medium may reduce the dielectric constant relative to dielectric bodies that do not have the gas bubbles and/or the gas-filled particles in the dielectric medium.

Figure 1:
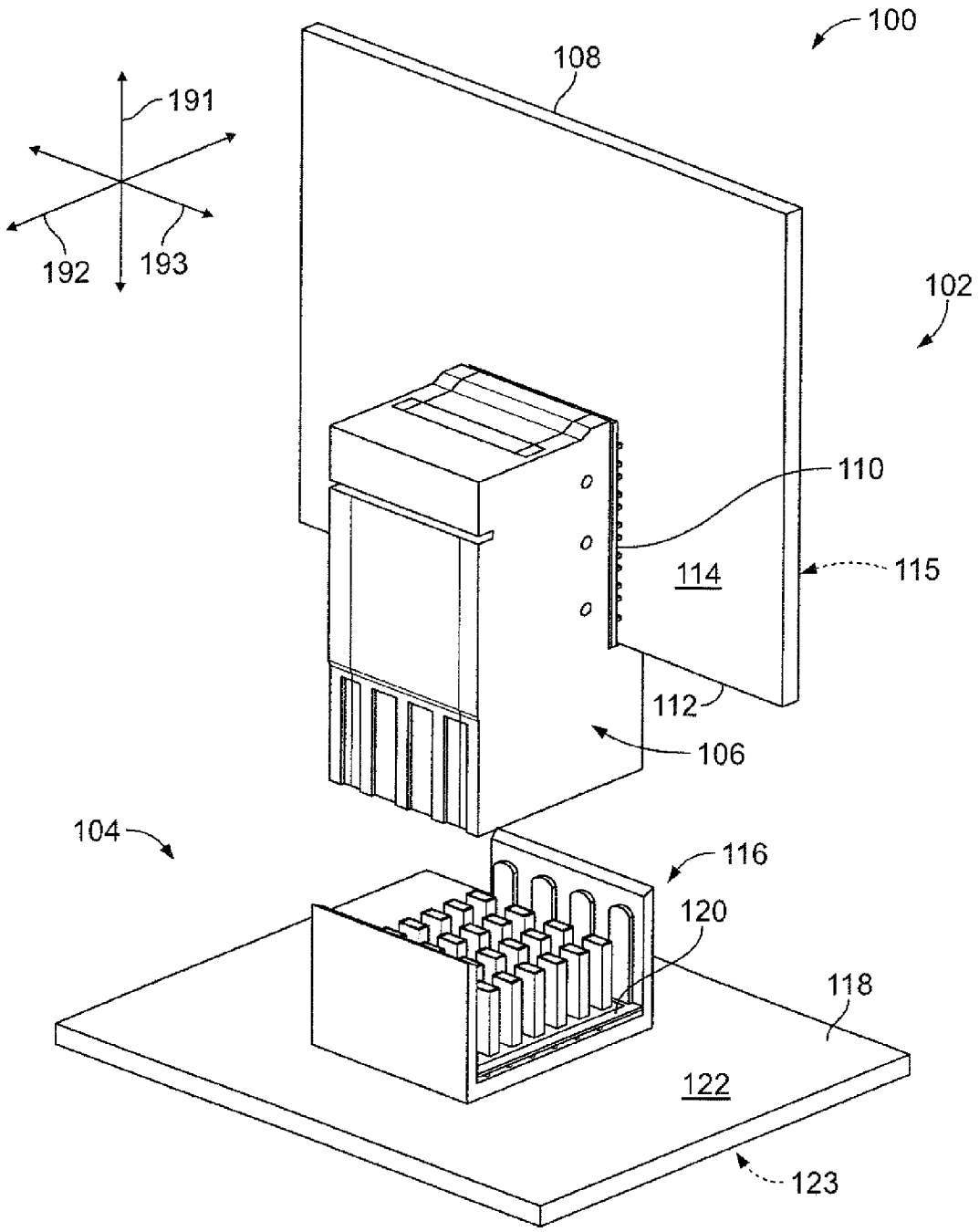
FIG. 1 is a perspective view of a system formed in accordance with one embodiment.

FIG. 1 illustrates a system 100 that includes a circuit board assembly 102 and a circuit board assembly 104 that are configured to engage each other during a mating operation. The system 100 is oriented with respect to mutually perpendicular axes 191-193, including a mating axis 191 and lateral axes 192, 193. As shown, the circuit board assembly 102 includes a first electrical connector 106 (hereinafter referred to as a receptacle connector 106), a circuit board 108, and a grounding matrix 110. The circuit board 108 includes a leading edge 112 and opposite first and second sides 114, 115. The receptacle connector 106 is mounted to the first side 114 along the leading edge 112.

Also shown, the circuit board assembly 104 includes a second electrical connector 116 (hereinafter referred to as a header connector 116), a circuit board 118, and a grounding matrix 120. The circuit board 118 has opposite first and second sides 122, 123. The circuit board assembly 104 may also include a grounding matrix (not shown) between the header connector 116 and the circuit board 118. The receptacle and header connectors 106, 116 are configured to engage each other during a mating operation as the receptacle and header connectors 106, 116 are moved relatively toward each other along the mating axis 191.

When the receptacle and header connectors 106, 116 are engaged, the grounding matrix 120 may be located along a mating interface 186 (shown in FIG. 4) between the receptacle and header connectors 106, 116. The grounding matrices 110 and 120 are configured to establish multiple contact points between two components along a corresponding interface so that a ground or return path is maintained during peration. The grounding matrices 110, 120 may improve the electrical performance (e.g., improve the communication of data signals) between the corresponding mated components. The grounding matrices 110, 120 are described in greater detail in U.S. Pat. No. 8,888,531, filed on Jun. 5, 2013, which is incorporated herein by reference in its entirety.

The system 100 may be used in various applications. By way of example, the system 100 may be used in telecom and computer applications, routers, servers, supercomputers, and uninterruptible power supply (UPS) systems. In such embodiments, the system 100 may be described as a backplane system, the circuit board assembly 102 may be described as a daughter card assembly, and the circuit board assembly 104 may be described as a backplane connector assembly. The receptacle and header connectors 106, 116 may be similar to electrical connectors of the STRADA Whisper or Z-PACK TinMan product lines developed by TE Connectivity. In some embodiments, the receptacle and header connectors 106, 116 are capable of transmitting data signals at high speeds, such as 10 Gbps, 20 Gbps, or more. Although the system 100 is illustrated as a backplane system, embodiments are not limited to such systems and may be used in other types of systems. As such, the receptacle and header connectors 106, 116 may be referred to more generally as electrical connectors.

Figure 2:
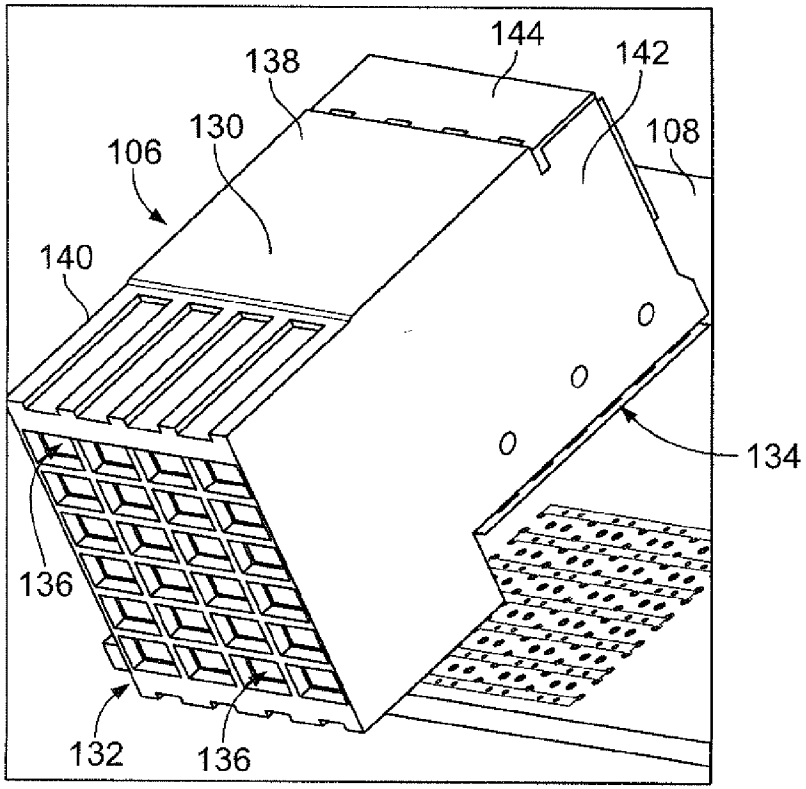
FIG. 2 is an isolated perspective view of a first electrical connector (or receptacle connector) that may be used with the system of FIG. 1.

FIG. 2 is a perspective view of the receptacle connector 106. As shown, the receptacle connector 106 includes a connector body 130 having a mating side 132 and a mounting side 134. The mating side 132 is configured to engage the header connector 116 (FIG. 1) and the mounting side 134 is configured to engage the circuit board 108. As shown, the receptacle connector 106 includes an array of socket cavities 136 along the mating side 132. Each of the socket cavities 136 is configured to receive one or more electrical terminals 152 (shown in FIG. 3) of the header connector 116. The socket cavities 136 may have one or more electrical contacts disposed therein, such as the socket contacts 204 (shown in FIG. 4). In alternative embodiments, the mating side 132 does not include socket cavities. For example, the mating side may have an array of electrical contacts projecting therefrom.

The receptacle connector 106 may include one or more contact modules 138. In the illustrated embodiment shown in FIG. 2, the receptacle connector 106 includes four contact modules 138 that are stacked side-by-side. As described in greater detail below, each of the contact modules 138 is configured to transmit signals between the circuit board 108 and the header connector 116. The stacked contact modules 138 may be positioned between opposite connector shields 140, 142. In the illustrated embodiment, the receptacle connector 106 also includes a rear shield 144 that engages each of the contact modules 138 and the connector shields 140, 142. The rear shield 144 and the connector shields 140, 142 may include conductive material (e.g., metal) to shield the signal conductors of the receptacle connector 106 and to provide a ground pathway.

Figure 3:
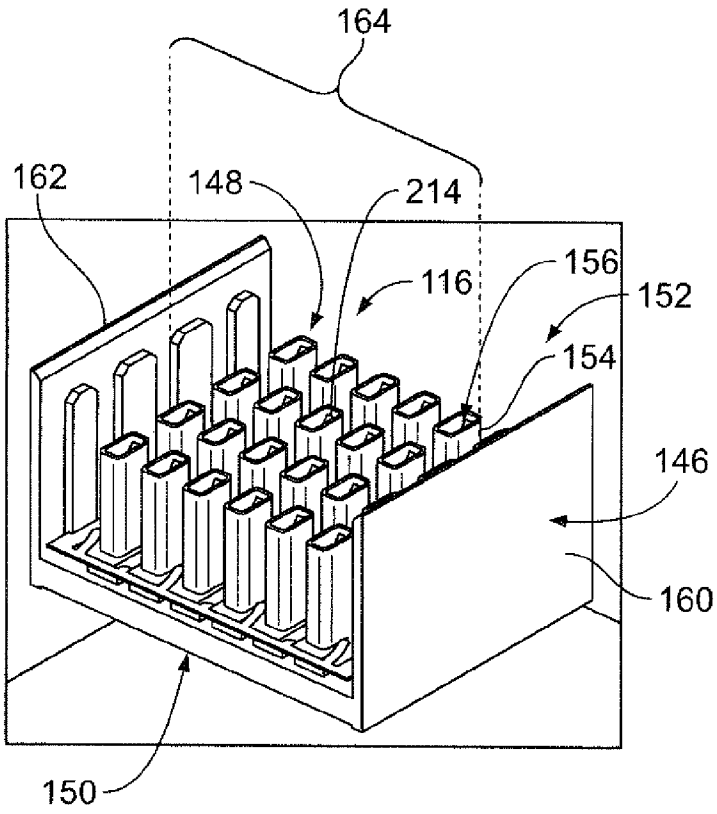
FIG. 3 is an isolated perspective view of a second electrical connector (or header connector) that may be used with the system of FIG. 1.

FIG. 3 is an isolated perspective view of the header connector 116. The header connector 116 includes a connector body 146 having a mating side 148 and an opposite mounting side 150. As shown, the mating side 148 includes the electrical terminals 152 disposed therealong. Each of the electrical terminals 152 includes a terminal housing 154 that defines a respective contact cavity 156. The contact cavity 156 has electrical contacts 214 (shown in FIG. 3) disposed therein. The terminal housings 154 are sized and shaped to be received by corresponding socket cavities 136 (FIG. 2) of the receptacle connector 106 (FIG. 2). The terminal housings 154 may comprise a dielectric medium having at least one of gas bubbles or gas-filled particles distributed therein as described in greater detail below. The terminal housings 154 may constitute an impedance-control assembly.

Also shown, the connector body 146 includes a pair of housing walls 160, 162 that project in a direction parallel to the electrical terminals 152. The housing walls 160, 162 define a connector-receiving region 164 therebetween. The electrical terminals 152 are disposed within the connector-receiving region 164. During the mating operation, the connector-receiving region 164 receives the mating side 132 (FIG. 2) of the receptacle connector 106 (FIG. 2).

Figure 5:
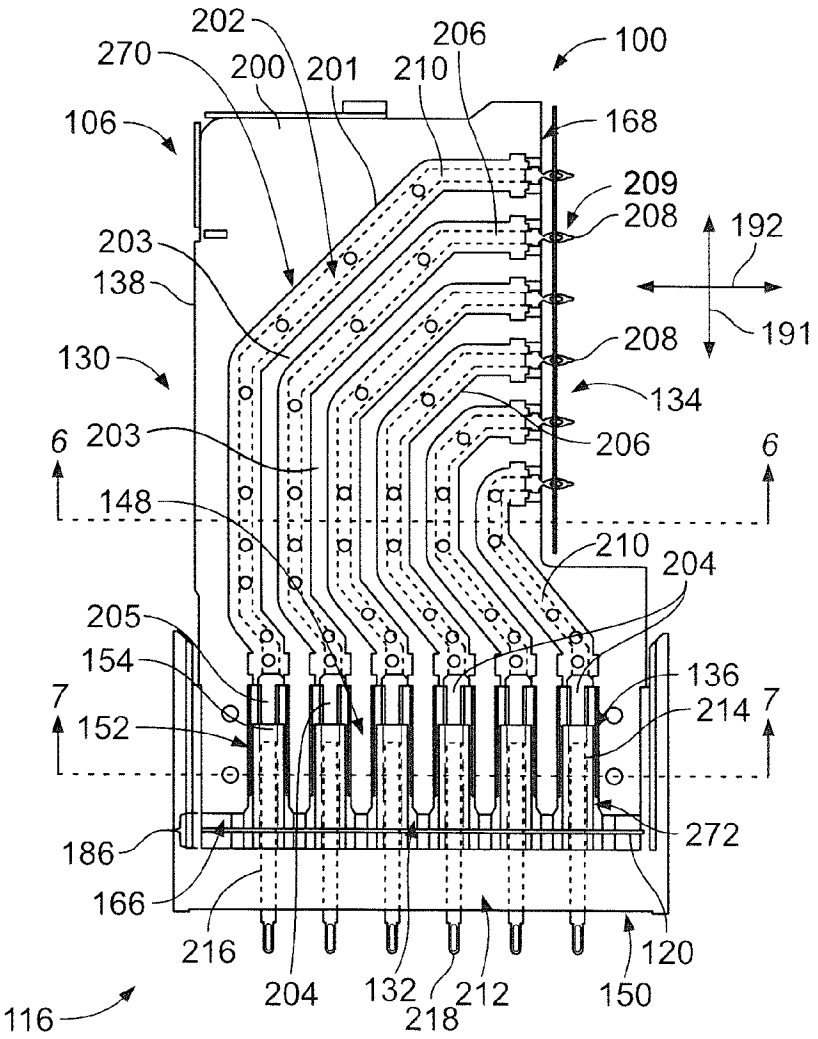
FIG. 5 is a side cross-section of the same portion of the system as shown in FIG. 4.
Figure 4:
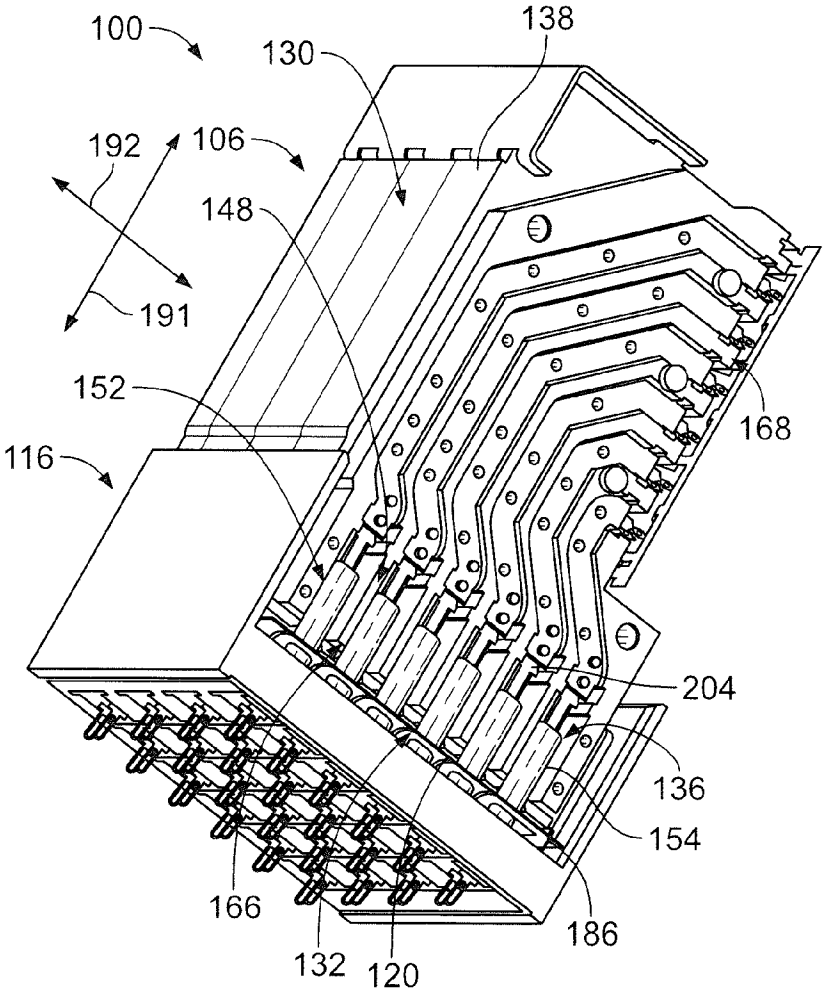
FIG. 4 is a perspective view of the system of FIG. 1 with a portion of the system removed to show a cross-section of the system.

FIG. 4 shows a perspective view a portion of the system 100 when the receptacle and header connectors 106, 116 are mated, and FIG. 5 is a side view of the same portion of the system 100 shown in FIG. 4. As shown, the receptacle connector 106 and the header connector 116 engage each other at a mating interface 186. During the mating operation, the mating side 132 of the receptacle connector 106 and the mating side 148 of the header connector 116 are advanced relatively toward each other along the mating axis 191. The electrical terminals 152 are received by corresponding socket cavities 136 when the receptacle connector 106 and the header connector 116 are engaged. More specifically, the receptacle connector 106 includes socket contacts 204 that are disposed within corresponding socket cavities 136 and directly engage the electrical contacts 214 (FIG. 5) disposed within the contact cavities 156 (FIG. 3) of the terminal housings 154. During the mating operation, the grounding matrix 120 may be compressed by and between the receptacle and header connectors 106, 116 to establish a ground pathway.

As shown in FIGS. 4 and 5, each of the contact modules 138 includes a mating edge 166 that has corresponding socket cavities 136 and a mounting edge 168. When the contact modules 138 are stacked side-by-side, the contact modules 138 may form the connector body 130, the mating edges 166 may collectively form the mating side 132, and the mounting edges 168 may collectively form the mounting side 134 of the receptacle connector 106.

In the illustrated embodiment, the mating side 132 and the mounting side 134 are oriented perpendicular to each other such that the mating side 132 faces in a mating direction along the mating axis 191 and the mounting side 134 faces in a mounting direction along the lateral axis 192. Accordingly, the receptacle connector 106 may be characterized as a right-angle connector. However, in alternative embodiments, the receptacle connector 106 may be a vertical connector in which the mating and mounting sides 132, 134 face in opposite directions along the mating axis 191.

With respect to FIG. 5, each of the contact modules 138 has a module body 200 that includes inner walls 203 that define a plurality of channels 201. The inner walls 203 extend lengthwise between the mating side 132 and the mounting side 134. In an exemplary embodiment, the module body 200 is a conductive structure or has surfaces that are metalized. The channels 201 extend through the corresponding module body 200 the mounting edge 168 of the corresponding contact module 138 and the mating edge 166 of the corresponding contact module 138. As shown, each of the contact modules 138 includes a plurality of signal pathways 202 that extend through the module body 200. In the illustrated embodiment, each of the signal pathways 202 includes a conductor end or tail 208 disposed along the mounting edge 168 (or the mounting side 134), a socket contact 204 disposed within a corresponding socket cavity 136, and a signal conductor 206. Each of the signal conductors 206 extends between and joins one of the conductor ends 208 and one of the socket contacts 204. The socket contact 204 and the conductor end 208 have respective contact surfaces 205, 209.

The socket contact 204, the signal conductor (or conductor body) 206, and the conductor end 208 may be part of a single continuous piece. For example, the socket contact 204, the signal conductor 206, and the conductor end 208 may be stamped and formed from sheet metal. In an exemplary embodiment, each of the signal pathways 202 from a single contact module 138 is stamped and formed from a common piece of sheet metal. However, in alternative embodiments, the signal pathways 202 may not be formed as continuous structures. Instead, it may be necessary to mechanically attach separate components to each other. For example, the socket contacts 204 may be soldered or fastened to the corresponding signal conductor 206.

As shown, at least a portion of each signal pathway 202 may be surrounded by a dielectric body 210 (hereinafter referred to as a dielectric rib 210). Each of the dielectric ribs 210 may be disposed within one of the channels 201 and follow along the path of the signal pathway 202. The dielectric ribs 210 are separated from one another by the inner walls 203. The dielectric medium of the dielectric rib 210 separates the signal conductor 206 from interior surfaces of the corresponding channel 201. As indicated by the dashed lines through each of the dielectric ribs 210, each of the signal conductors 206 extends through and is surrounded by one of the dielectric ribs 210. The contact surfaces 205, 209 are exposed to an exterior of the corresponding dielectric bodies 210 and are configured to removable engage corresponding contact of the electrical component.

Also shown in FIG. 5, a plurality of signal pathways 212 extend through the header connector 116. Each of the signal pathways 212 includes a conductor end or tail 218 disposed along the mounting side 150, an electrical contact 214, and a signal conductor 216. The electrical contact 214 is disposed within a corresponding contact cavity 156 (FIG. 3). The contact cavities 156 are defined by the terminal housings 154. Each of the signal conductors 216 extends between and joins one of the conductor ends 218 and one of the electrical contacts 214. The electrical contact 214, the signal conductor 216, and the conductor end 218 may be part of a single continuous piece. For example, the electrical contact 214, the signal conductor 216, and the conductor end 218 may be stamped and formed from sheet metal.

Embodiments described herein may include an impedance-control assembly having a plurality of dielectric bodies that are configured to control impedance of the corresponding electrical connector. For example, the plurality of dielectric ribs 210 in one of the contact modules 138 or the dielectric ribs 210 in the receptacle connector 106 may constitute an impedance-control assembly 270. Likewise, the plurality of terminal housings 154 may constitute an impedance-control assembly 272 of the header connector 116. As described herein, the dielectric bodies (e.g., the dielectric ribs 210, the terminal housings 154, and the like) include a dielectric medium and at least one of gas bubbles or gas-filled particles distributed in the dielectric medium. The dielectric medium has a predetermined dielectric constant and the gas bubbles and/or the gas-filled particles are sized and distributed in the dielectric medium to achieve a target dielectric constant of the dielectric bodies. The dielectric bodies may be discrete dielectric bodies.

Figure 6:
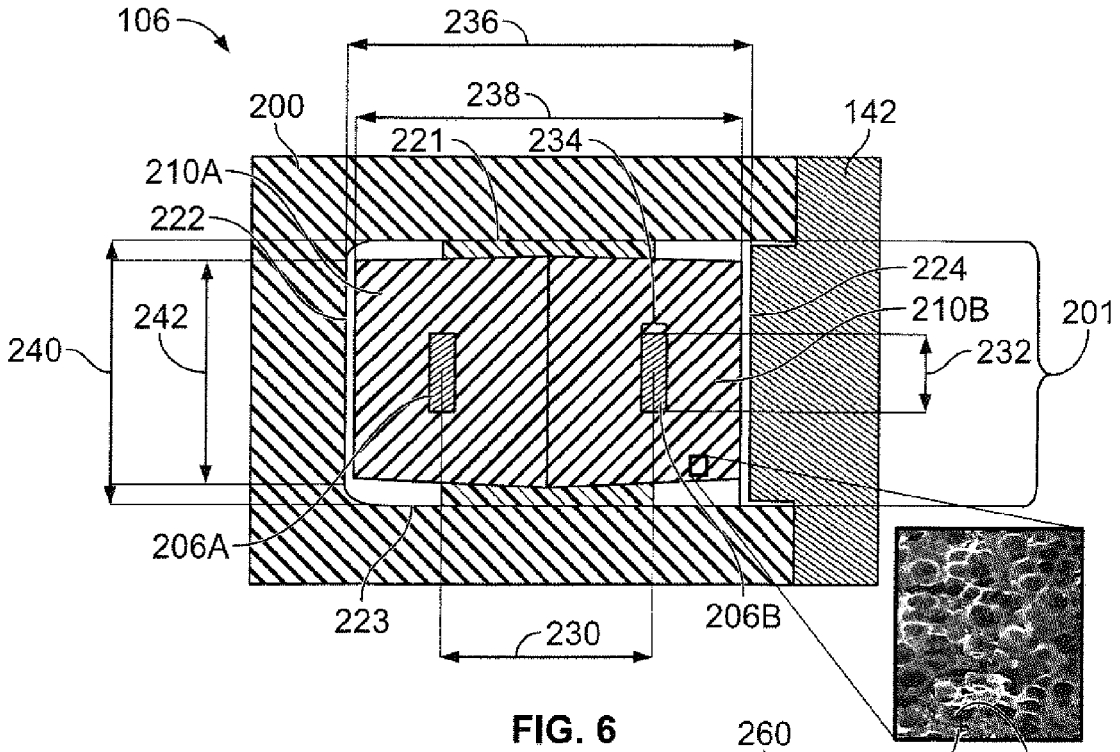
FIG. 6 is an enlarged cross-section of the first electrical connector taken along the line 6-6 in FIG. 5 and illustrates a single pair of signal pathways in greater detail.

FIG. 6 is an enlarged cross-section of the receptacle connector 106 taken along the line 6-6 in FIG. 5. A single channel 201 is shown in FIG. 6. The channel 201 is defined by a portion of the module body 200 and a portion of the connector shield 142. As shown, first and second signal conductors 206A, 206B are disposed in the channel 201 and first and second dielectric ribs 210A, 210B surround the first and second signal conductors 206A, 206B, respectively. In the illustrated embodiment, the dielectric ribs 210A, 210B are distinct bodies that are positioned side-by-side. However, in other embodiments, the dielectric ribs 210A and 210B may be combined to form a single dielectric body.

Interior surfaces 221-223 of the module body 200 and an interior surface 224 of the connector shield 142 surround the dielectric ribs 210A, 210B. The interior surfaces 221-224 may be metalized or comprise a conductive material. Accordingly, the first and second signal conductors 206A, 206B are immediately surrounded by dielectric medium of the dielectric ribs 210A, 210B, respectively, that are surrounded by the interior surfaces 221-224. In some embodiments, an air gap may exist between the dielectric ribs 210A, 210B and corresponding interior surfaces 221-224.

The receptacle connector 106 may be configured to have a target impedance. For example, in addition to the composition of the dielectric ribs 210A, 210B, dimensions of the signal conductors 206A, 206B, dimensions of the dielectric ribs 210A, 210B, and dimensions of the interior surfaces 221-224 may be configured in a predetermined manner to achieve the target impedance. The first and second conductors 206A, 206B have a center-to-center spacing 230. Each of the first and second conductors 206A, 206B may have a conductor height 232 and a conductor width 234. The channel 201 may have a channel width 236 and the dielectric ribs 210A, 210B may be combined to have a rib width 238. The channel 201 may also have a channel height 240 and the dielectric ribs 210A, 210B may have a rib height 242. By way of one specific example, the center-to-center spacing 230 may be about 1.2 mm; the conductor height 232 may be about 0.54 mm; the channel width 236 may be about 2.3 mm; the rib width 238 may be about 2.2 mm; the channel height 240 may be about 1.48 mm; and the rib height 242 may be about 1.3 mm.

As shown in the expanded portion of the dielectric rib 210B, the composition of the dielectric rib 210B may include a dielectric medium and at least one of gas bubbles or gas-filled particles that are distributed throughout the dielectric medium. In some embodiments, the dielectric rib 210B may be characterized as a polymeric foam.

Figure 7:
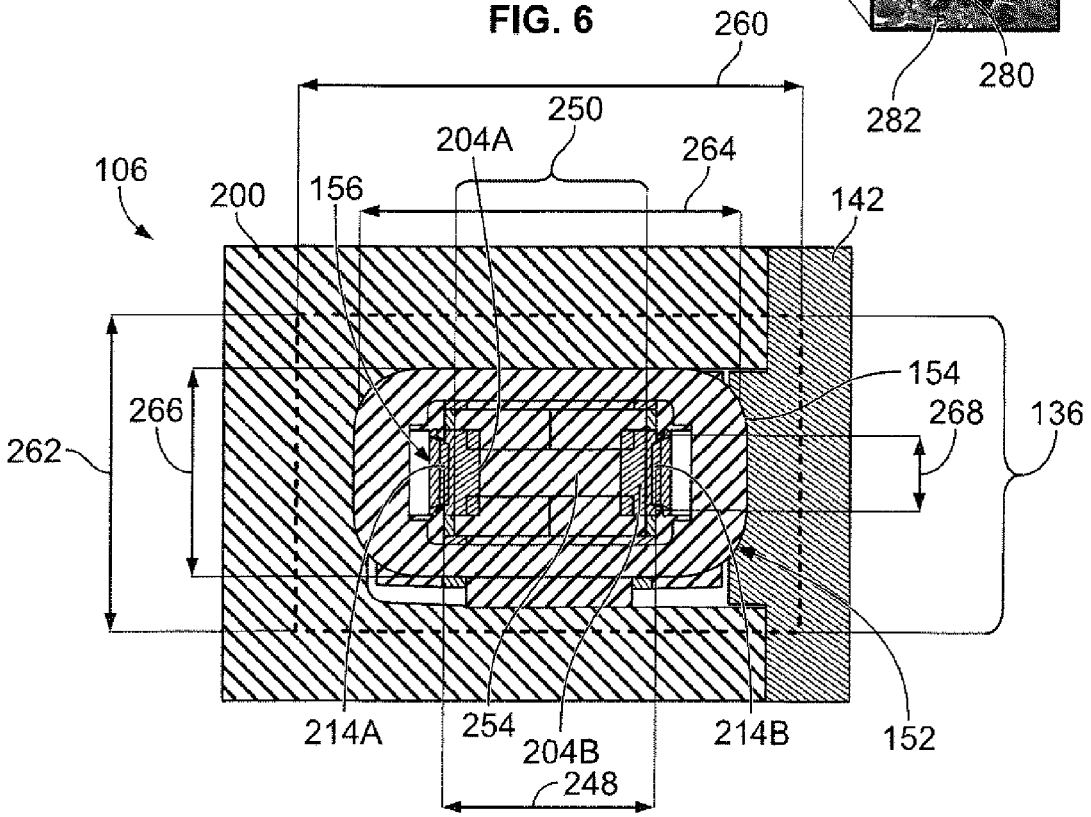
FIG. 7 is an enlarged cross-section of the second electrical connector taken along the line 7-7 in FIG. 5 and illustrates a single pair of signal pathways in greater detail.

FIG. 7 is an enlarged cross-section that includes one of the electrical terminals 152 received within one of the socket cavities 136 (indicated by a dashed rectangle) of the receptacle connector 106. FIG. 7 is taken along the line 7-7 in FIG. 5. As shown, the socket cavity 136 is defined by a portion of the module body 200 and a portion of the connector shield 142. The socket cavities 136 may be extensions of corresponding channels 201 (FIG. 5). The socket cavity 136 is sized and shaped to receive the corresponding terminal housing 154 of the electrical terminal 152. The electrical terminal 152 has a pair of electrical contacts 214A, 214B disposed in the contact cavity 156 defined by the terminal housing 154. The electrical contacts 214A, 214B are separated from each other by a center-to-center spacing 248.

The receptacle connector 106 includes a plurality of mating assemblies 250 that are configured to be inserted into corresponding electrical terminals 152. As shown in FIG. 7, the mating assembly 250 includes socket contacts 204A, 204B and a dielectric partition or divider 254 that separates the socket contacts 204A, 204B. The socket contacts 204A, 204B are partially embedded within opposite sides of the dielectric partition 254. The dielectric partition 254 may be an extension of the dielectric ribs 210 (FIG. 5) or, alternatively, may be separate from the dielectric ribs 210. As shown, the mating assembly 250 is received within a gap between the electrical contacts 214A, 214B. The electrical contacts 214A, 214B directly engage the socket contacts 204A, 204B within the contact cavity 156.

The electrical terminals 152 and the mating assemblies 250 may also be configured to achieve a target impedance. As described herein, the compositions of the terminal housing 154 and the dielectric partition 254 may be configured such that the terminal housing 154 and the dielectric partition 254 have designated dielectric constants. In addition to the composition of the terminal housing 154 and the dielectric partition 254, dimensions (e.g., size and shape) of the terminal housing 154 and the dielectric partition 254, dimensions of the socket contacts 204A, 204B, and dimensions of the electrical contacts 214A, 214B may be configured in a predetermined manner to achieve the target impedance. As described above, the electrical contacts 214A, 214B have a center-to-center spacing 248. Moreover, the socket cavity 136 may have a cavity width 260 and a cavity height 262; the terminal housing 154 may have a housing width 264 and a housing height 266; and the electrical contacts 214A, 214B may have a contact height 268. By way of one specific example, the center-to-center spacing 248 may be about 1.4 mm; the cavity width 260 may be about 3.2 mm; the cavity height 262 may be about 2.0 mm; the housing width 264 may be about 2.5 mm; the housing height 266 may be about 1.3 mm; and the contact height 268 may be about 0.55 mm.

As described herein, embodiments may include dielectric bodies that comprise a dielectric medium and gas bubbles or gas particles with an approximate size and distribution in the dielectric medium. Generally, dielectric medium having gas bubbles and/or the gas-filled particles will have a dielectric constant that is less than the dielectric constant of the same dielectric medium without the gas bubbles and/or the gas-filled particles. To illustrate, an enlarged portion of the dielectric rib 210B in FIG. 6 is shown and includes gas bubbles 280 within a dielectric medium 282. By way of example, the gas bubbles may have an approximate diameter between about 0.1 micrometer to about 500 micrometers. The gas-to-material ratio may be between about 1:10 and 10:1 or, more specifically, between 1:5 and 5:1 or, even more particularly, between about 1:3 to 3:1. In certain embodiments, the dielectric bodies have a gas-to-material ratio between 1:10 and 3:1.

Gas bubbles or gas-filled particles may be added to a dielectric medium by various methods. During the manufacture of the dielectric ribs 210 and the terminal housings 154, a dielectric medium in a liquid state may be injected into a mold that forms the dielectric medium into a designated shape. Optionally, the conductive elements that are surrounded (e.g., encased) by the dielectric medium may be positioned within the mold. For instance, to form the dielectric ribs 210, the signal conductors 206 may be held in designated positions to allow the molten or liquid dielectric medium to flow around and encase the signal conductors 206.

The molten dielectric medium may then harden and/or cure to form a solid dielectric body (e.g., dielectric rib 210).

Prior to the molten dielectric medium being hardened and/or cured, gas bubbles or gas-filled particles may be added to the molten dielectric medium. For example, the gas bubbles and/or the gas-filled particles may be added to the molten dielectric medium before the molten dielectric medium is injected into the mold. In some cases, hollowed microspheres (e.g., gas-filled particles) are mixed with the molten dielectric medium or a supercritical fluid is added to the molten dielectric medium. Various parameters may be controlled to obtain the desired characteristics of the dielectric body, such as a target dielectric constant. The target dielectric constant of the dielectric bodies may be between 1.5 and 4.0.

The dielectric bodies may include one or more dielectric media that are suitable for surrounding conductive elements and are capable of having gas bubbles or gas-filled particles added thereto. Non-limiting examples of dielectric medium that may be suitable for embodiments set forth herein include liquid crystalline polymer (LCP), acrylonitrile butadiene styrene (ABS), acrylic, celluloid, ethylene vinyl alcohol (EVA), fluoropolymers, ionomers, polyacetal (POM), polyacrylates, polyamide (PA), polyamide-imide (PAI), polyaryletherketone (PAEK), polybutylene terephthalate (PBT), polyethylene terephthalate (PET), polycarbonate (PC), polyketone (PK), polyester, polyethylene (PE), polyetheretherketone (PEEK), polyetherimide (PEI), polyimide (PI), polylactic acid (PLA), polypropylene (PP), polystyrene (PS), polysulfone (PSU), and/or polyvinyl chloride (PVC), polytetrafluoroethylene (PTFE). Extruded plastics, such as, but not limited to, extruded polystyrene, are other examples of materials that the dielectric bodies may be fabricated from. Still other examples include thermosets, such as, but not limited to, phenol formaldehyde resin, duroplast, polyester resin, and/or epoxy resin. In particular embodiments, the dielectric medium is a polymeric foam, such as an LCP, Nylon (e.g., polyamide), or PBT foam. In particular embodiments, the dielectric medium includes hollowed microspheres.

Various processes exist for adding gas bubbles or gas-filled particles into the dielectric medium. In some cases, the method of manufacturing the dielectric bodies and, more specifically, the method of adding the gas bubbles or the gas-filled particles to the dielectric medium may be identified by inspection of the dielectric body. For example, a portion of the dielectric body may be removed to expose a cross-section or interior of the dielectric body. This portion may be examined using, for example, a scanning electron microscope (SEM) or other microscope. By way of example only, the distribution of bubbles or particles, the appearance of the gas bubbles or particles, the range in sizes of the gas bubbles or particles, and/or an aggregation of the gas bubbles or particles within the dielectric medium may be indicative of the method of manufacturing. Furthermore, other characteristics (e.g., surface characteristics or features of the dielectric medium) may be identifiable through inspection of the dielectric body and may be indicative of the method of manufacturing. Accordingly, when the dielectric bodies are described as being manufactured in a particular manner, it is understood that the method of manufacturing may cause certain structural features that are identifiable through inspection of the dielectric bodies. Thus, terms such as "supercritical-gas molded" or "blow-agent molded" may describe identifiable structural feature(s) of the dielectric body.

One method for adding gas bubbles or gas-filled particles to the dielectric medium includes adding hollowed particles (e.g., microspheres). The hollowed particles may be added to a liquid form (e.g., molten resin) of the dielectric medium before the dielectric medium is injected into a mold for forming the corresponding dielectric bodies. The hollowed particles may include the gas bubbles therein. Effectively, the hollowed particles and the gas bubbles decrease the dielectric constant of the dielectric body relative to the dielectric body without the hollowed particles. The particles may comprise a similar dielectric medium as the remainder of the dielectric body or, alternatively, may comprise a different material. By way of example, a range in diameters of the microspheres may be about 10 micrometers to about 500 micrometers.

The dielectric bodies may also be polymeric foams. Polymeric foams are generated by mixing a molten polymer (e.g., the dielectric medium) and a gas together. Parameters may be controlled to ensure that the two phases will mix in such a manner that a polymer matrix with gas bubbles is generated. The gas that is used to generate the foam is referred to as a blowing agent. The blowing agent can be a chemical blowing agent or a physical blowing agent. Chemical blowing agents are chemicals that take part in a reaction or decompose to generate the gas bubbles. Physical blowing agents are gases that do not react chemically in the foaming process.

As another example for adding gas bubbles, a supercritical fluid may be mixed with the dielectric medium to form encapsulants therein. A supercritical fluid is any substance at certain temperature and pressure above its critical point, where distinct liquid and gas phases do not exist. Various factors of this process may be controlled to control the resulting porosity and dielectric constant of the dielectric body. The supercritical fluid may be, for example, nitrogen or carbon dioxide. As one specific example, supercritical nitrogen or carbon dioxide gases may be injected into a melted polymer to create a single-phase, homogenous solution of the supercritical gas in the molten polymer under high pressure. The dissolved gas operates as a plasticizer. Once injected into the mold, the supercritical gas is released from the molten polymer causing simultaneous nucleation and growth of millions of bubbles or cells. The simultaneous nucleation and growth (also called foaming) rapidly expands the volume of the liquid polymer within the cavity of the mold. The mold forms the shape of the polymer. Parameters that may be used to control the characteristics of the microcellular injected body include polymer melt viscosity, part weight, and injection cycle time.

Such molds may be referred to as foams (e.g., microcellular foams). These foams may have a pore size from, for example, 0.1 to 100 micrometers and may be manufactured to have between 5% and about 99% of the base material with the remainder gas.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector body having a mating side configured to interface with an electrical component;

signal pathways extending through the connector body, the signal pathways being arranged to form pairs of signal pathways; and an impedance-control assembly including a plurality of dielectric bodies supported by the connector body, the dielectric bodies surrounding respective pairs of the signal pathways, wherein the dielectric bodies comprise a dielectric medium and gas-filled particles distributed in the dielectric medium, the dielectric medium having a predetermined dielectric constant, wherein the gas-filled particles are sized and distributed in the dielectric medium to achieve a target dielectric constant of the dielectric bodies, wherein the gas-filled particles include hollowed particles.

2. The electrical connector of claim 1, wherein the target dielectric constant of the dielectric bodies is between 1.5 and 4.0.

3. The electrical connector of claim 1, wherein the dielectric bodies include polymeric foam having the dielectric medium and the at least one of the gas bubbles or gas-filled particles.

4. The electrical connector of claim 1, wherein the dielectric bodies are molded with a chemical or physical blowing agent.

5. The electrical connector of claim 1, wherein the dielectric bodies have a gas-to-material ratio between 1:10 and 3:1.

6. The electrical connector of claim 1, wherein a cross-sectional impedance of the pairs of signal pathways surrounded by the dielectric bodies is either about 100 ohm or about 85 ohm.

7. The electrical connector of claim 1, wherein the electrical connector is a receptacle connector and the dielectric bodies constitute dielectric ribs, the dielectric ribs forming the impedance-control assembly.

8. The electrical connector of claim 1, wherein the electrical connector is a header connector and the dielectric bodies constitute terminal housings, the terminal housings forming the impedance-control assembly.

9. The electrical connector of claim 8, wherein the terminal housings have contact cavities that are sized and shaped to have the signal pathways therein.

10. The electrical connector of claim 1, wherein the hollowed particles comprise a dielectric medium that is different than the dielectric medium of the dielectric bodies.

11. The electrical connector of claim 1, wherein the hollowed particles include microspheres having diameters between 10 micrometers and 500 micrometers.

12. The electrical connector of claim 1, wherein each of the signal pathways includes a conductor tail, a socket contact, and a signal conductor extending therebetween and joining the corresponding conductor tail and corresponding socket contact, the signal conductor being entirely encased within the dielectric body for substantially an entire length between the conductor tail and the socket contact, each of the conductor tail and the socket contact including one of the contact surfaces that is exposed to the exterior of the dielectric body.

13. The electrical connector of claim 1, wherein each signal pathway is surrounded by a distinct dielectric body and wherein the distinct dielectric bodies that surround the signal pathways of a pair of signal pathways are positioned side-by-side.

14. An electrical connector comprising:

a series of contact modules stacked side-by-side forming a connector body, the connector body having a mounting side and a mating side, each of the contact modules including a module body having inner walls that form separate channels and a plurality of discrete dielectric ribs that extend generally between the mating and mounting sides, the inner walls extending lengthwise between the mating side and the mounting side, the dielectric ribs being disposed within respective channels and being separated from one another by the inner walls; and signal pathways extending through each of the contact modules, wherein each of the dielectric ribs surrounds at least a portion of one of the signal pathways, the dielectric ribs comprising a dielectric medium and gas-filled particles distributed in the dielectric medium, the dielectric medium having a predetermined dielectric constant, wherein the gas-filled particles are sized and distributed in the dielectric medium to achieve a target dielectric constant of the dielectric ribs, the gas-filled particles include hollowed particles.

15. The electrical connector of claim 14, wherein the dielectric ribs include polymeric foam having the dielectric medium and the gas-filled particles.

16. The electrical connector of claim 14, wherein the target dielectric constant of the dielectric medium is between 1.5 and 4.0.

17. The electrical connector of claim 14, wherein interior surfaces define the separate channels of the corresponding module body, the interior surfaces being metalized or comprising a conductive material, the dielectric ribs separating the corresponding signal pathways from the interior surfaces that define the respective channels.

18. The electrical connector of claim 14, wherein the channels are open-sided channels that open in a common direction, the electrical connector further comprising a connector shield including a conductive material, the connector shield being coupled to the module body and positioned to cover the open-sided channels thereby enclosing the dielectric ribs within the respective channels.

19. The electrical connector of claim 14, wherein the hollowed particles include microspheres having diameters between 10 micrometers and 500 micrometers.

* * * * *